US006109431A

United States Patent [19]

Ledniczky et al.

[11] Patent Number: 6,109,431

[45] Date of Patent: Aug. 29, 2000

[54] STORAGE CONTAINER

[76] Inventors: Maria Pálfiné Ledniczky, Amfiteátrum u. 20, H-1031 Budapest; János Samu, Thököly u. 33, H-1158 Budapest, both of Hungary

[21] Appl. No.: 09/125,230

[22] PCT Filed: Dec. 4, 1997

[86] PCT No.: PCT/HU97/00080

§ 371 Date: Jun. 11, 1999

§ 102(e) Date: Jun. 11, 1999

[87] PCT Pub. No.: WO98/26988

PCT Pub. Date: Jun. 25, 1998

[30] Foreign Application Priority Data

Dec. 16, 1996 [HU] Hungary ..... 9603460

[51] Int. Cl.[7] ..... B65D 81/32

[52] U.S. Cl. ..... 206/219; 206/221; 215/DIG. 8

[58] Field of Search ..... 206/219–221, 206/568; 215/DIG. 8, 6, 10, 44

[56] References Cited

U.S. PATENT DOCUMENTS

| | | | |
|---|---|---|---|
| 2,385,648 | 9/1945 | Prager | 215/DIG. 8 |
| 2,974,785 | 3/1961 | Griffon . | |
| 4,386,696 | 6/1983 | Goncalves . | |
| 4,591,050 | 5/1986 | Finke et al. . | |
| 4,776,972 | 10/1988 | Barrett | 206/221 |
| 4,793,475 | 12/1988 | Itzel | 206/221 |
| 4,903,828 | 2/1990 | Finke et al. | 215/DIG. 8 |

FOREIGN PATENT DOCUMENTS

| | | |
|---|---|---|
| 0 077 556 A2 | 4/1983 | European Pat. Off. . |
| WO 90/04547 | 5/1990 | WIPO . |
| WO 94/07757 | 4/1994 | WIPO . |

*Primary Examiner*—Jacob K. Ackun
*Assistant Examiner*—Luan K. Bui
*Attorney, Agent, or Firm*—Finnegan, Henderson, Farabow, Garrett & Dunner, LLP

[57] ABSTRACT

A storage container for making mixtures is provided. The storage container includes a receptacle with a threaded neck and a threaded locking cap screwed on the neck for closing the receptacle, and a substance carrying element arranged in the neck for storing separately gas and/or liquid and/or solid substance(s) to be introduced into a medium stored in the receptacle. The substance carrying element is connected sealingly but releasably to the locking cap and adapted to be brought by turning the locking cap in a condition disengaged from the neck and the locking cap for translating downward into the receptacle. The locking cap is configured to move the substance carrying element between a locking and a dropping position. An outer face of the substance carrying element is provided with an oval flange sitting in locking position on inside lips in the neck of the receptacle and fits in dropping position in an opening between the inside lips.

8 Claims, 2 Drawing Sheets

STORAGE CONTAINER

BACKGROUND OF THE INVENTION

1. Field of the Invention

The invention relates to a storage container for fresh preparation of mixtures before their use, furthermore a process to make gas and/or liquid and/or solid substance storaged separately in the neck of the stored container.

2. Description of the Related Art

It is well known that there are such solutions in that the physical and chemical character of the storaged liquid can be changed and formed in an advantageous state for use.

A locking cap and container combination has been disclosed in the PCT patent application WO 94/07757, a little device built in the cap gives a pleasant smell in the inside of the bottle storing chemicals, detergents of unpleasant smell.

In the PCT patent application WO 90/04547 a container is disclosed for storage and treating of liquids; in the neck of the container there is a column filled with a cleaning medium which is able to treat the liquid. Pouring out the liquid, it flows through that clearing medium, immediately before use.

In the latter invention the object was how to remove, before use, undesirable components from liquids stored in containers.

On the other hand a demand has frequently been arised, dissolved active ingredients must not be decomposed during storage. It can be monitored for example water solutions, soft drinks containing ascorbic acid and different flavoring and fragrances. The chemical decomposition of above mentioned and many other substances in water solution (e.g. active oxydizing agents in household chemicals) is well known. For that reason it is an obvious task the storing of substances, which are install in water solution, possible gas and/or liquid and/or solid or their mixture, in a storage container, but isolated from the content of that.

On the other hand it is necessary, that before use the isolated gas and/or liquid and/or solid components must be mixed with the content of the container, namely only in the time when the user wants. So both the early dissolving of the isolate stored, components and the remaining not dissolved substances are avoided.

SUMMARY OF THE INVENTION

In such a case it is a possible solution: the container must be provided with such a locking cap, that at the opening takes initiative for happening of the contact, mixing, in a wanted case reaction between the isolated stored components and the content of the container.

The invention is aimed to provide a storage container with a receptacle in the neck portion of which carrying element for separated storing of gas and/or liquid and/or solid substances is arranged wherein these substances can be brought in contact with a medium stored in the receptacle by unscrewing the locking cap while the connection of the carrying element and the locking cap enables, in contrast to the known solutions, an opening of the locking cap with a less powerful turning and a free dropping of the carrying element into the receptacle.

Thus, the present invention relates to a storage container comprising a receptacle with a threaded neck and a threaded locking cap screwed on the neck for closing the receptacle, further comprising a substance carrying element arranged in the neck portion for storing separately gas and/or liquid and/or solid substance(s) to be introduced into a medium stored in the receptacle, the substance carrying element being connected sealingly but releasably to the locking cap and being adapted to be brought by turning the locking cap in a condition disengaged from the neck and the locking cap for falling into the receptacle, wherein according to the invention the locking cap includes a positioning element for turning the substance carrying element between a locking a dropping position, the outer face of the substance carrying element being provided with an oval flange sitting in locking position on inside lips in the neck of the receptacle and fitting in dropping position in the opening between the inside lips.

In a further aspect of the invention, the outer face of the substance carrying element is provided with at least two uniformly disposed short threaded parts, connected turnable to short threaded parts arranged in sections on the inner face of the neck portion.

In an preferred embodiment of the present invention the suitable oval flange of the mixing substance carrying element sits on the inside lips in the neck of the storage container, and its upper part fits in the cavity of the locking cap. The locking cap closes the element and the storage container at the same time.

In an additional preferable introduction of the invention the flange formed advantageously oval, the introducing substance carrying element sits on the inside lips of the neck and the inside lips are configured with two stops, approximately at 180°, for the oval flange of the element.

That preferred embodiment enhances the handling comprising the inside lips and stops placed in an inner piece in the neck of the storage container. The position of the introducing substance carrying element is inserted similarly to above configuration, between the locking cap and inside lips, the element is disengaging from locking cap and inside lips.

Another preferred embodiment is comprising the cylindrical outer side of the introducing substance carrying element, provided with a short threaded surface enabling a turnable connection a thread divided into sections in the inner side of the neck of the storage container. In that embodiment the locking cap is including a turning lever to provide a turning move introducing substance carrying element between a locking and a dropping position.

It is preferred for production to make the locking cap, the storage container and the introducing substance carrying element of plastics (e.g. injection molding), or metal. This invention can be realised from paper, fibre, or tetrapack boxes as well. That closing arrangement can be comprising a threaded or bayonet locking cap.

Practical application can be favoured by providing the locking cap with an originally indicating collet.

A process has been elaborated for introducing of gas and/or liquid and/or solid substances stored separately in the neck of the storage container into the inside of storage container at the time of opening.

According to this process with the opening of the locking cap of storage container, the introducing substance carrying element will be turned by the wall of the cavity of the locking cap, or friction, or a turning lever from locking to dropping position, the introducing substance carrying element drops into the inside of storage container and the separately stored gas and/or liquid and/or solid substance(s) will be mixed, solved or reacted with the medium stored there.

According to the invention the figures make the structure and function of the storage container, locking cap and the introducing substance carrying element known.

DESCRIPTION OF THE PREFERRED EMBODIMENTS

Figure 1:
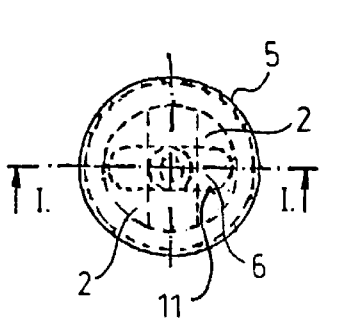
FIG. 1 is a section and top view of the storage container, locking cap, inside lips in the neck and the introducing substance carrying element in locked position according to the invention.
Figure 1:
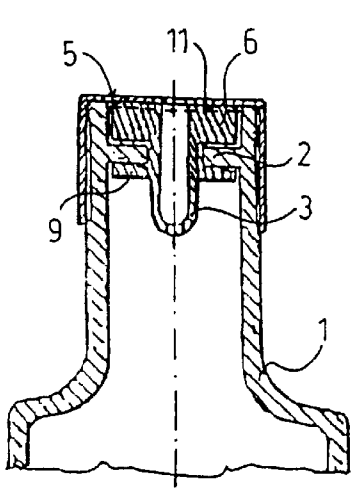

FIG. 1 shows the storage container 1, in its neck has been built inside lips 2, tightening the round formed through passage of the neck of the storage container 1, so the oval formed flange 6 of the introducing substance carrying element 3 sits on the inside lips 2. The position securing flange 9 ensures the isolation of the introducing substance carrying element 3 from the locking cap 5 at the opening. Usually the locking cap 5 rises up at opening, the introducing substance carrying element 3 must not be risen up in the same time, it must be divided to be able to drop into the inside of the storage container 1. The position securing flange 9 is important for the vertical fastening of the introducing substance carrying element 3. The upper part of the oval flange 6 of the introducing substance carrying element 3 fits in the cavity 11 of the locking cap 5.

Figure 2:
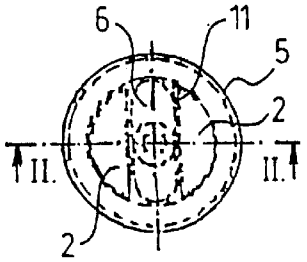
FIG. 2 is a section and top view of the storage container, locking cap, lips in the neck and the introducing substance carrying element in dropping position.
Figure 2:
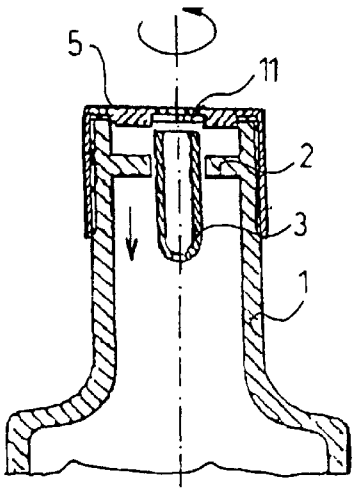

FIG. 2 shows the system, in case of 90° turning of the flange 6 sitting on the inside lips 2, so it is in dropping position.

Figure 3:
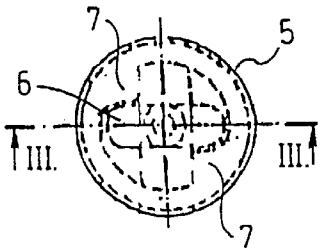
FIG. 3 is a section and top view of the storage container, locking cap, inside lips in the neck with stops on the lips and the introducing substance carrying element in closed position.
Figure 3:
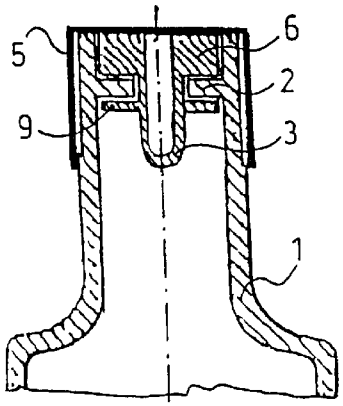
Figure 4:
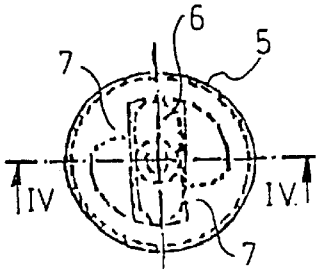
FIG. 4 is a section and top view of the storage container, locking cap, inside lips with stops and the introducing substance carrying element in dropping position.
Figure 4:
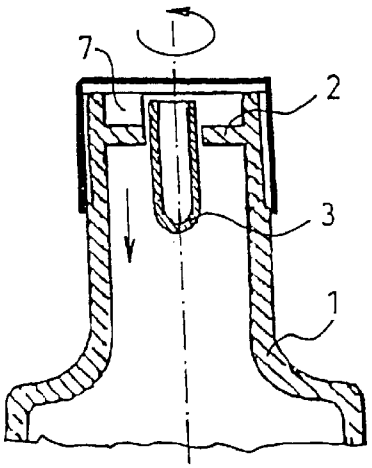

FIGS. 3 and 4 show such inside lips 2, comprising two stops 7.

Figures 5, 6, 7, 8:
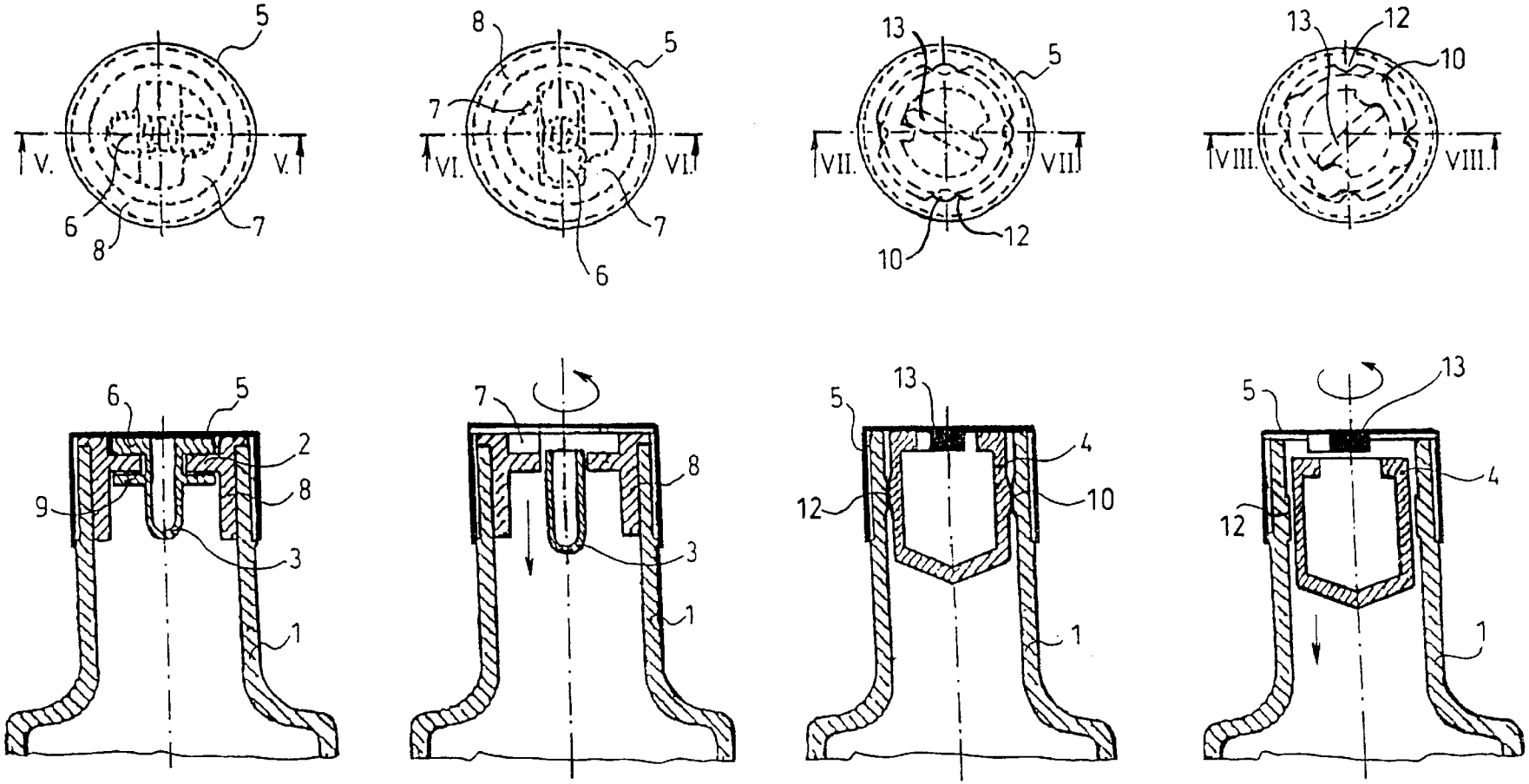
FIG. 5 is a section and top view of the storage container, locking cap, inside lips with stops and the introducing substance carrying element in locking position. The inside lips are constructed as parts of an inner piece.
FIG. 6 is a section and top view of the storage container, locking cap, inside lips with stops and the introducing substance carrying element in dropping position. The inside lips are constructed as parts of an inner piece.
FIG. 7 is a section and top view of the storage container, locking cap, and the introducing substance carrying element in locking position. The introducing substance carrying element is secured with thread in the neck of the storage container.
FIG. 8 is a section and top view of the storage container, locking cap, and the introducing substance carrying element in dropping position according to our invention. The introducing substance carrying element is secured with thread in the neck of the storage container.

FIGS. 5 and 6 show an inner piece 8 placed in the neck of the storage container 1, on the inside lips 2 there are stops 7, the introducing substance carrying element 3 sits on the inside lips 2.

FIG. 5 shows the locking cap 5, closing the storage container 1 and the introducing substance carrying element 3. FIG. 6 shows the introducing substance carrying element 3 being turned in plugging position on inside lips 2 of the inner piece 8.

FIGS. 7 and 8 show a threaded part 12 divided into sections in the neck of the storage container 1. On the cylindrical outer side of the introducing substance carrying element 4 is favourable four short threaded surfaces 10 in 90° to each other. In the other part of the inside of the locking cap 5 there is a turning lever 13.

FIG. 7 shows the locking position, while the FIG. 8 shows the plugging position of the introducing substance carrying element 4, in the latter the threaded part 12 does not connect to the threaded neck inside.

The use of storage container according to the invention

On the FIG. 1 and FIG. 2 depicted embodiment comprises in the storage container 1, filled advantageously with liquid, the introducing substance carrying element 3 filled with gas and/or liquid and/or solid substances, so that its flange 6 can sit on the inside lips 2. The storage container 1 can be closed with the locking cap 5, in this embodiment by a formed thread. So the flange 6 of the introducing substance carrying element 3 fits in the cavity 11 of the locking cap 5. It ensures the separation and storage of the components of introducing substance carrying element 3. That is a locking position for the introducing substance carrying element 3. At the opening of the storage container 1 by turning of the locking cap 5, the introducing substance carrying element 3 will be turned too, and moves in dropping position, while the position securing flange 9 tightens to the down surface of the inside lips 2, so hindering to rise up the introducing substance carrying element 3. The introducing substance carrying element 3 turning in dropping position can get across the opening of the inside lips 2 into the advantageously liquid medium of storage container. There the components stored separately till the opening can be mixed, solved and reacted with each other. After dropping of the introducing substance carrying element 3 into the storage container 1 the locking cap 5 can be closed and later opened.

In the case, represented by the FIGS. 3 and 4, the friction power makes the introducing substance carrying element 3 turned from the stops 7 in dropping position at the opening of the locking cap 5. The content of the introducing substance carrying element 3 drops into the medium stored in the inside of storage container 1, it will be there mixed, solved, or reacted. The role of the stops 7 is hindering the turning of the flange 6 of the introducing substance carrying element 3 in dropping position at the locking of the filled up storage container 1, by the locking cap 5 turning in locking position. The dropping of the introducing substance carrying element 3 occurs only at the first opening of the locking cap 5.

"Dropping position" means not only the moment when the introducing substance carrying element 3 or 4 loses the contact with the locking cap 5 and the inside lips 2 of the storage container, but its dropped position in the medium storaged in the inside of stored container 1 as well.

The use of the locking cap 5, introducing substance carrying element 3 and storage container 1 according to FIGS. 5 and 6 is similar to that introduced in FIGS. 3 and 4. In this case the inner piece is advantageous from the point of view of production, and the flange 6 of the introducing substance carrying element 3 sits on the inside lips 2 of that. At the opening the friction power between the locking cap 5 and the flange 6 of the introducing substance carrying element 3 makes the introducing substance carrying element 3 turned in dropping position. The introducing substance carrying element 3 drops into the inside of the storage container 1 and its stored gas and/or liquid ad/or solid substance will desirable to mixed with the medium, favourable liquid, stored in the inside of the storage container 1.

In case of the embodiment, according to FIGS. 7 and 8, the short threaded surface of the cylindrical outer side 10 of the introducing substance carrying element 4 containing gas and/or liquid and/or solid substance(s) in contact with the also short threaded surface 12 of the neck of the storage container 1 and closing finally the storage container 1 and the introducing substance carrying element 4 with the locking cap 5 in the same time. The locking cap 5 can have a right hand thread, or in the direction of a right hand thread locking bayonet lock and the introducing substance carrying element 4 cylindrical outer side 10 and the threaded part in the neck of the storage container 12 must have left hand thread. (The relation of the direction of threads can be inversely, but the same as well.) At the opening the introducing substance carrying element 4 will be turned by means of the turning lever 13, that is in the inside of the locking cap 5 so the contacting short threaded surfaces 10 and 12 turn in lack of threads and the introducing substance carrying element 4 drops into the inside of storage container and has the containing substances mixed with the medium in the inside of storage container 1.

The benefit of the storage container, according to the invention is that it safely protects the gas and/or liquid and/or solid substance(s) stored separately in the introducing substance carrying element 4, until the wanted opening the storage container, before use. The production of this system is simple, its embodiment in the form of an inner piece can be applied to conventional flasks, too. The locking cap 5 can be provided with an originally indicating collet.

What is claimed is:

1. A storage container for making mixtures, comprising a receptacle with a threaded neck and a threaded locking cap screwed on the neck for closing the receptacle, and a substance carrying element arranged in the neck for storing separately gas and/or liquid and/or solid substance(s) to be introduced into a medium stored in the receptacle, the substance carrying element being connected sealingly but releasably to the locking cap and being adapted to be brought by turning the locking cap in a condition disengaged from the neck and the locking cap for translating downward into the receptacle, wherein the locking cap is configured to move the substance carrying element between a locking and a dropping portion, an outer face of the substance carrying element being provided with an oval flange sitting in locking position on inside lips in the neck of the receptacle and fitting in dropping position in the opening between the inside lips.

2. The storage container as claimed in claim 1, wherein two stops are arranged on the inside lips at an angle of about 180° to each other.

3. The storage container as claimed in claim 2, wherein a position securing flange is arranged below the inside lips parallel to the oval flange.

4. The storage container as claimed in claims 2 or 3, wherein the inside lips and the stops are formed on an inner face of an insert element fitted into the neck of the receptacle.

5. The storage container as claimed in claims 2 or 3, wherein a cavity is provided inside the locking cap for receiving the oval flange of the substance carrying element.

6. A storage container for making mixtures, comprising a receptacle with a threaded neck and a threaded locking cap screwed on the neck for closing the receptacle, and a substance carrying element arranged in the neck for storing separately gas and/or liquid and/or solid substance(s) to be introduced into a medium stored in the receptacle, the substance carrying element being connected sealingly but releasably to the locking cap and being adapted to be brought by turning the locking cap in a condition disengaged from the neck and the locking cap for translating downward into the receptacle, wherein the locking cap is configured to move the substance carrying element between a locking and a dropping portion, an outer face of the substance carrying element being provided with at least two uniformly disposed short threaded parts, connected turnable to short threaded parts arranged in sections on an inner face of the neck.

7. The storage container as claimed in claim 6, wherein the inside of the locking cap is provided with a turning lever for engaging with an upper opening of the substance carrying element.

8. The storage container as claimed in any one of claims 1, 2, 3, 6 or 7, wherein the receptacle, the locking cap and the substance carrying element are made of injection molded plastics or metal.

* * * * *

UNITED STATES PATENT AND TRADEMARK OFFICE

CERTIFICATE OF CORRECTION

PATENT NO.: 6,109,431

DATED: August 29, 2000

INVENTORS: Maria LEDNICZKY et al..

It is certified that an error appears in the above-identified patent and that said Letters Patent is hereby corrected as shown below:

In Claim 1, col. 5, line 43, "dropping portion" should read --dropping position--.

In Claim 6, col. 6, line 30, "dropping portion" should read --dropping position--.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*